United States Patent [19]

Phillips

[11] 3,970,032

[45] July 20, 1976

[54] PADDLE

[76] Inventor: Wayne R. Phillips, 8537 Second St., Cordova, Tenn. 38018

[22] Filed: Dec. 9, 1974

[21] Appl. No.: 530,529

Related U.S. Application Data

[63] Continuation-in-part of Ser. No. 450,991, March 13, 1974, abandoned, which is a continuation-in-part of Ser. No. 365,040, June 20, 1973, abandoned.

[52] U.S. Cl. ..... 115/24.1; 416/70 R

[51] Int. Cl.[2] ..... B63H 16/04

[58] Field of Search ..... 115/24.1; 416/69, 70, 416/71, 72, 74

[56] References Cited

UNITED STATES PATENTS

| | | | |
|---|---|---|---|
| 1,107,169 | 8/1914 | Kerns | 416/74 |
| 3,086,492 | 4/1963 | Holley | 115/24.1 |

FOREIGN PATENTS OR APPLICATIONS

| | | | |
|---|---|---|---|
| 7,685 | 9/1889 | United Kingdom | 416/74 |

*Primary Examiner*—Trygve M. Blix
*Assistant Examiner*—Jesus D. Sotelo
*Attorney, Agent, or Firm*—John R. Walker, III

[57] ABSTRACT

A paddle for manually propelling a canoe or the like. The paddle includes the usual grip member establishing the upper end thereof and the usual blade member establishing the lower end thereof. An intermediate member is included which interconnects the grip member and the blade member with the major axis of the grip member angularly aligned with the plane of the blade member. Certain elements of the intermediate member may be rotatably connected one to the other by a longitudinally extending pivot pin. Accordingly, relative rotational movement of these elements may be effective to vary the pitch of the blade member with respect to the grip member. Quick release locking structure may also be included for selectively locking the blade member to the grip member in any one of several discrete predetermined positions.

14 Claims, 5 Drawing Figures

PADDLE

CROSS-REFERENCE TO RELATED APPLICATION

This is a continuation-in-part of my application, Ser. No. 450,991, filed Mar. 13, 1974, entitled "Variable Pitch Paddle", which was a continuation-in-part of my application, Ser. No. 365,040, filed June 20, 1973, entitled "Paddle Having Angular or Adjustable Positioned Grip", both now abandoned.

BACKGROUND OF THE INVENTION

1. Field of the Invention

This invention relates to the field of paddles of manually propelling waterborne craft.

2. Description of the Prior Art

Applicant is aware of the Herring U.S. Pat. No. 1,807,289; the Korth U.S. Pat. No. 1,817,414; and the Wisbrod U.S. Pat. No. 3,091,781. None of the above patents suggest or disclose applicant's device.

The usual practice in paddling a canoe or the like with prior paddles is to alternate the paddling strokes from the left-hand side of the canoe to the right-hand side in order to keep the canoe in a straight course. This technique requires considerable experience in order to keep the canoe on a straight course. In addition, the constant changing from the left-hand side to the right-hand side causes considerable water to drip into the canoe which compounds the aggravation. The above problems were recognized by certain of the above-mentioned patents. One of such patents included a baffle or shield disposed about the shaft of the paddle so as to prevent the water running downwardly on the shaft toward the near end or into the canoe. Another attempt at avoiding the constant changing from the left to the right side of the canoe included means for joining a pair of remotely extending paddles which are intended to be alternately stroked in order to keep the canoe on a straight course. Obviously, a paddle of this length necessitated incorporating means for disassembling the pair of paddles and also conveniently included a pair of handles which could selectively be attached to the pair of paddles to reconstitute them to completely separate paddles if desired.

Another of the above-mentioned patents pertains to an improved canoe paddle in which the handle is joined with the blade by an improved coupling piece so constructed and designed with reference to the handle that such handle will receive adequate support throughout the extension area thereof, and in which the connection between the handle and the joint will be made quickly and expeditiously while the removal of the parts is facilitated. It should be pointed out that variable pitch of the latter mentioned paddle was not anticipated by the inventor. In other words, while the structure disclosed provides for positioning the blade at various angular positions relative to the grip, it has not been suggested or disclosed by any of the prior known devices.

Another well-known technique which is used to keep a canoe on a straight course without alternating from one side of the canoe to the other is a stroke commonly referred to as the "J" stroke. It will be appreciated by those skilled in the art that the J stroke is very tiring to the wrists of the boatman. Additionally, mastering the J stroke involves considerable experience in the art of paddling a canoe.

In fact, it can accurately be concluded that keeping a singularly paddled boat on a smooth straight course has plagued boatmen for years and possibly centuries. According to the known prior art and practices as exemplified by certain of the above-mentioned patents, paddles which may be disassembled generally are constructed by tapered or friction fit members which are held together in any suitable manner. These prior paddles may be separated but only with cumbersome motion and are joined back together by a time-consuming technique rendering them nonconducive to easy or quick and repeated angle adjustments. Certainly, none of these prior paddles could be considered to include structure for making angular pitch adjustments while being used to paddle a canoe.

SUMMARY OF THE INVENTION

The present invention is directed toward overcoming the disadvantages and problems relative to previous paddles for propelling canoes and the like. The concept of the present invention is to provide a paddle in which the major axis of the grip member thereof is angularly aligned with the plane of the blade member thereof. In addition, the paddle of the present invention may include a feature enabling the blade to have a variable pitch or which permits easy quick change angular adjustment to promote user enthusiasm requiring minimum skill to master. The instant invention also eliminates the necessity of paddling on both sides of a canoe in an effort to maintain a straight and true watercraft course and accomplishes this without the use of the J stroke or other tiresome course correctional methods. More specifically, the instant variable pitch paddle permits quick and repeated adjustment of the pitch angle while the paddle is in use and the watercraft is in progressive motion. This variable pitch feature is beneficial in compensating for turning torques as they are created by normal paddling, windage, or water currents, i.e., while paddling on a single side of the craft. In other words, the instant paddle may include structure for selectively locking certain movable parts of the paddle in any one of several discrete predetermined positions whereby various degrees of slip-streams of water may selectively be urged across the blade member of the paddle as the user grasps the paddle in a uniform manner while propelling the watercraft.

The instant paddle includes the usual grip member establishing the upper end thereof and the usual blade member establishing the lower end thereof. An intermediate member is included which interconnects the grip member and blade member with the major axis of the grip member angularly aligned with the plane of the blade member. Certain elements of the intermediate member may be rotatably connected one to the other by a longitudinally extending pivot pin. Accordingly, relative rotational movement of these elements may be effective to vary the pitch of the blade member with respect to the grip member. Quick release locking structure may also be included for selectively locking the blade member to the grip member in any one of several discrete predetermined positions.

During the course of action while this instant paddle is in use, a simple, quick and accurate adjustment can be made thereto which will increase or decrease the grip to blade working plane relationship. This is accomplished by a simple pull on the grip member which disengages the quick release locking structure and permits a new rotational angle position to be quickly reset which is effective to change counter-torque-pitch for blade slip-stream action against the blade surfaces as desired by the user during progress in various situations where water and wind currents are changing paddling conditions.

DESCRIPTION OF THE PREFERRED EMBODIMENT

Figure 4:
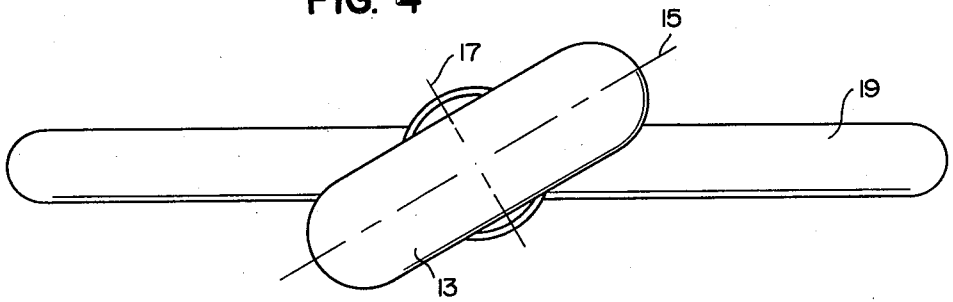
FIG. 4 is an end view of the paddle of the present invention looking towards the upper end thereof and showing the plane of the blade member shifted to a position which is misaligned with the major axis of the grip member.

The paddle 11 of the present invention is intended for manually propelling waterborne craft, e.g., canoes or the like. The paddle 11 generally comprises a grip member 13 establishing the upper end of the paddle 11 and having major and minor axes thereto, as shown at 15, 17 respectively in FIG. 4 of the drawings. A blade member 19 is provided establishing the lower end of the paddle 11. Also included is an elongated intermediate member, as a 21, having the grip member 13 attached to the upper end thereof and the blade member 19 attached to the lower end thereof with the major axis 15 of the grip member 13 angularly aligned with the plane of the blade member 19. The paddle 11 may be a one-piece construction having the grip member 13, blade member 19, and elongated intermediate member 21 axially aligned and fixed relative to one another. Additionally, pivot means, as at 23, may be provided which coextend with the longitudinal axis of the paddle 11. If provided, the pivot means are attached to the elongated intermediate member 21, in a manner to be described for providing pivotal movement of the grip member 13 relative to the blade member 19 whereby the major axis 15 of the grip member 13 may selectively be angularly aligned and disaligned with the plane of the blade member 19. Further, quick release locking means, as at 25, may be included for selectively locking the grip member 13 to the blade member 19 in any one of the several discrete predetermined positions while the craft is being propelled with the paddle 11. It should be understood that the blade member 19 may be of any well-known construction according to the current state of the art, i.e., it may be formed from various well-known materials and have various sizes and shapes for various specific purposes well known to those skilled in the art.

The intermediate member 21 includes a lower portion 27, which is fixedly attached to the blade member 19, and distal and proximal loom elements, as at 29, 31 respectively. The pivot means 23 pivotally connects the distal and proximal loom elements 29, 31 one to the other in a manner to be fully described as the specification proceeds.

Figure 1:
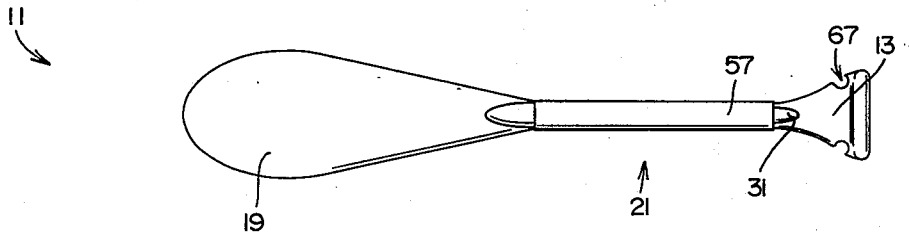
FIG. 1 is an elevational view of the paddle of the present invention.
Figure 2:
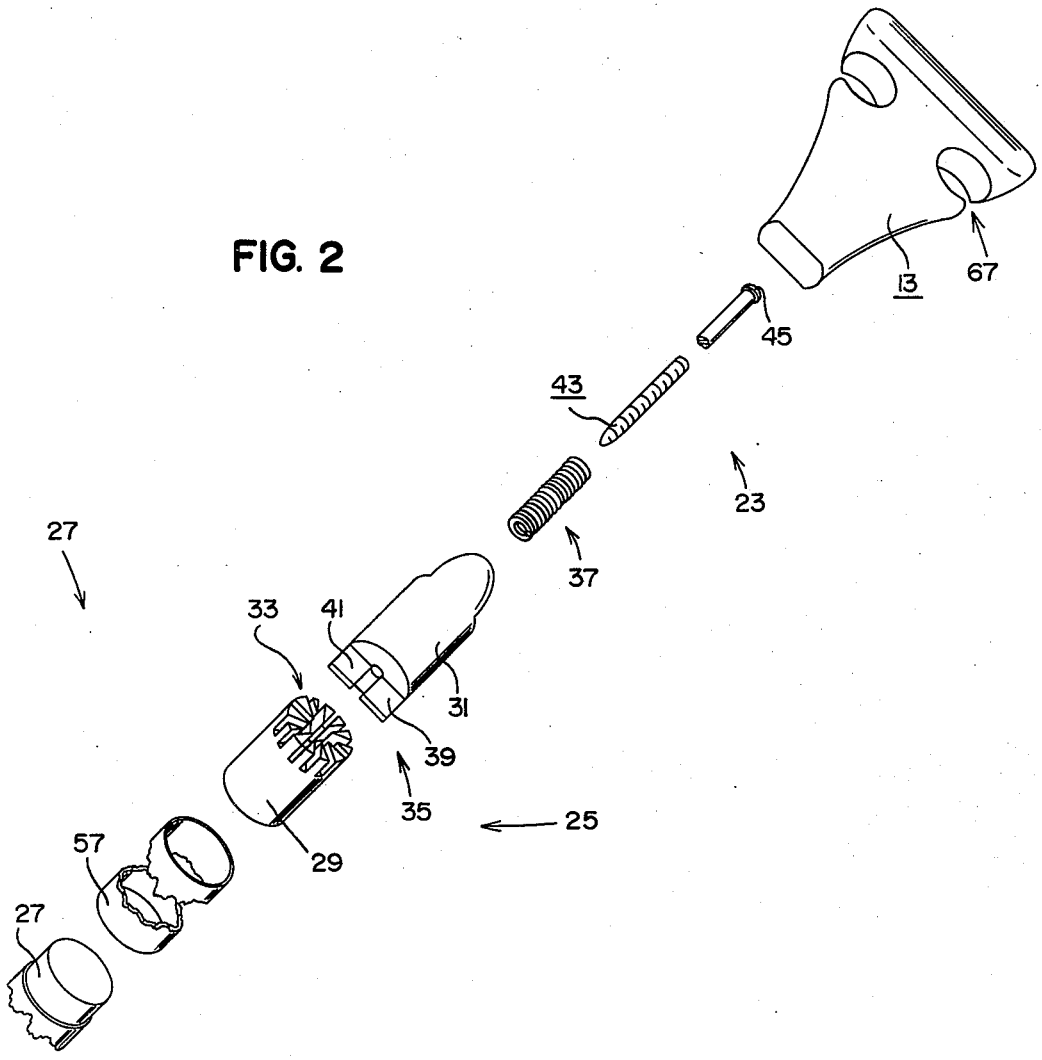
FIG. 2 is an enlarged exploded perspective view of the upper end of the paddle of the present invention.

The quick release locking means 25 includes providing the distal loom element 29 with a plurality of slots, as shown at 33 in FIG. 2, which extend radially outwardly from the pivot means 23. Additionally, the quick release locking means 25 includes tongue means, as at 35, fixedly attached to the proximal loom element 31 and projecting longitudinally toward the slots 33 for selectively thrusting reception therein to establish the several discrete predetermined positions of the quick release locking means 25.

The quick release locking means 25 additionally includes compression spring means, as at 37, for yieldably urging the tongue means 35 towards the slots 33. In this regard, the tongue means 35 is disengagable from the slots 33 by compressing the spring means. It should be understood that the spring means 37 may be compressed by pulling upwardly on the grip member 13, i.e., since the grip member 13 is fixedly attached to the proximal loom element 31 in a manner to be fully disclosed later in the specification.

From FIG. 2 of the drawings it may clearly be seen that the plurality of slots 33 are numerous and are closely spaced one to the other, i.e., preferably being at least 12 in number or having a center to center angular displacement of 30°. Further, placing the tongue means 35 in any of the plurality of slots 33 is effective to lock the distal and proximal loom elements 29, 31 one to the other. Accordingly, the pitch angle of the blade member 19 may quickly be changed selectively in 30° increments with respect to the major axis 15 of the grip member 13. In other words, the plane of the paddle 11 may be adjusted in both directions from the major axis 15 of the grip member 13, i.e., establishing the variable pitch suitable for paddling on the left-hand side of the canoe or on the right-hand side of the canoe. The quickness with which the blade member 19 may be varied is an important feature of the present invention. In other words, the quick release locking means 25 enables the tongue means 35 to freely and quickly be disengaged from the slots 33 by compressing the spring means or moving the grip member 13 upwardly. The tongue means 35 preferably includes at least a pair of tongue members 39, 41 radially disposed 180° one from the other which respectively may be engaged with a pair of slots 33 which are also angularly disposed 180° one from the other.

The pivot means 23 preferably includes a screw member, as at 43, having a head portion, as at 45. From FIG. 5 of the drawings it may be seen that the distal loom element 29 is provided with a longitudinally extending concentric bore, as at 47, for threadedly receiving the lower end of the screw member 43. Additionally, the proximal loom element 31 is provided with a longitudinally extending concentric aperture, as at 49. The aperture 49 is defined in part by an annular shoulder, as at 51, establishing small and large diameter portions, as at 53, 55, respectively. The compression spring means 37 is disposed in the large diameter portion 55 with the lower portion of the spring means 37 restingly engaging the annular shoulder 51. The screw member 43 extends through the aperture 49 with the compression spring means 37 being circumferentially disposed thereabout. The head portion 45 of the screw member 43 captures the compression spring means 37 by engaging the upper end thereof.

Figure 5:
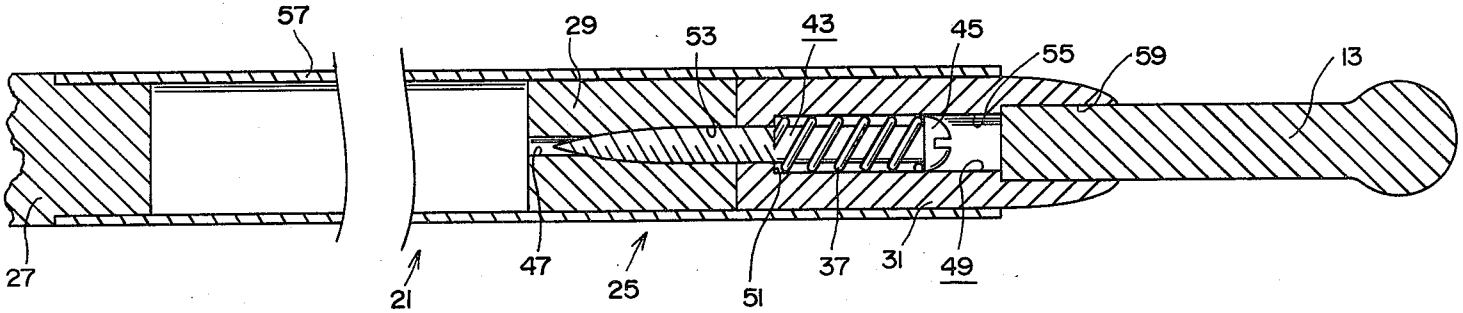
FIG. 5 is a sectional view taken as on the line V—V of FIG. 3.

The paddle 11 may be further characterized by having all the movable structure including the quick release locking means 25 obscured. This is accomplished in part by including sleeve means 57 for circumferentially engaging the distal and proximal loom elements 29, 31. The lower portion 27 and the distal loom element 29 are disposed a spaced distance one from the other as shown in FIG. 5 and are fixedly attached to the sleeve means 57. However, the proximal loom element 31 is free to slide to and fro within the upper end of the sleeve means 57 a predetermined distance along the longitudinal axis of the paddle 11 and is also free to rotate thereabout.

The pivot means 23 and the compression spring means 37 are obscured by providing a transverse groove, as at 59, in the proximal loom element 31. The transverse groove 59 is disposed remotely from the tongue means 35, i.e., the aperture 49 leads outwardly into the transverse groove 59. The lower portion of the grip member 13 extends into the transverse groove 59 with the grip member 13 being fixedly attached to the proximal loom element 31 in any well-known manner, e.g., as with adhesive (not shown) or the like.

Figure 3:
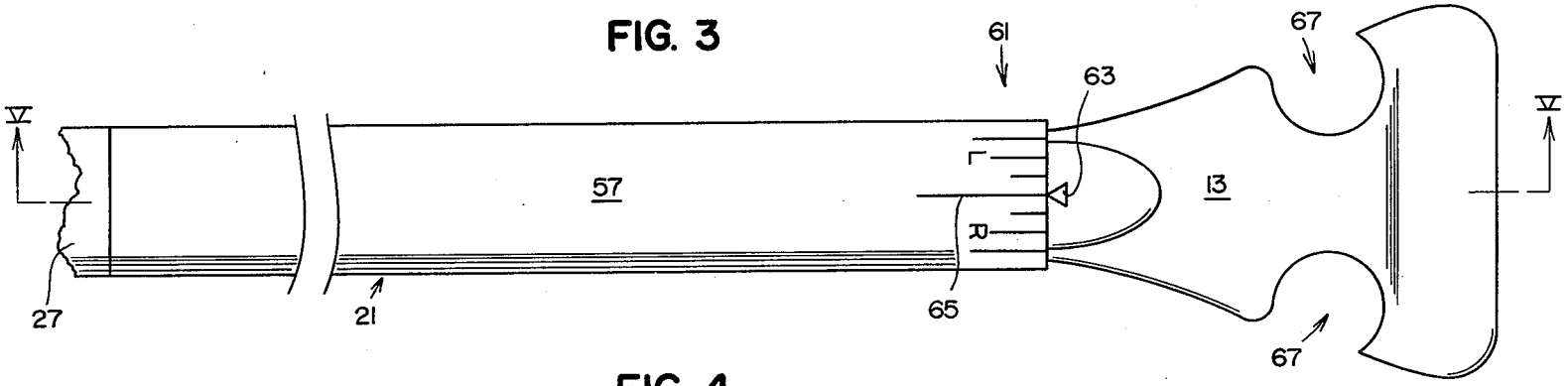
FIG. 3 is an enlarged assembled view of the structure depicted in FIG. 2.

The paddle 11 may include position alignment indicia means, as at 61 in FIG. 3 of the drawings for facilitating the positioning of the grip member 13 selectively to specific ones of the several discrete predetermined positions. More specifically, the indicia 61 preferably includes a pointer or pip, as at 63, which is applied in any suitable manner to the proximal loom element 31. Additionally, the indicia 61 includes a graduated scale, as at 65, which is applied to the sleeve means 57 in any suitable manner. The graduated scale 65 preferably has a centering position to indicate when the blade member 19 is aligned with the major axis 15 of the grip member 13. Additionally, the graduated scale 65 preferably includes marks as clearly shown to indicate several right-hand positions or positions which indicate the blade member 19 is displaced selectively in a misaligned position to the right of the aligned position. Additionally, the graduated scale 65 preferably includes several left-hand marks to indicate the several positions in which the blade member 19 may be selectively misaligned to the left of the major axis 15.

The paddle 11 preferably includes grapple means, as at 67, for seizing certain objects, e.g., articles of clothing or minnow buckets or the like, which may be situated in the vicinity of the waterborne craft or the canoe. In other words, the grapple means 67 consists of hook shaped notches provided in the grip member 13. From the above disclosure and a study of the drawings it may readily be seen that the paddle 11 of the present invention is a one-side-stroking paddle that allows waterborne craft to be manually propelled in a straight line without requiring difficult correctional methods heretofore required. When the paddle 11 includes the pivot means 23, the paddle 11 can be easily adjusted to suit the individual user's personal characteristics of stroking speed and body frame. The grip member 13 can be pulled upwardly disengaging the angle setting, while the grip member 13 is held in the disengaged position. It can be rotated to any angle desirable to the individual user's needs. Accordingly, by setting the proper blade pitch angle into the paddle 11, the turning torque normally created with prior paddles is elminated while paddling a canoe or the like. Thus, a straight course is maintained while paddling one one side of the canoe without wasted effort in course correctional thrust or paddling on the opposite side. The blade pitch may be changed any time at will to compensate for windage and water current increases and decreases while paddling is in progress.

The cross body reach by right or left hand and firm straight arm with fist hold on paddle grip is an angular position in varying degrees for each individual user. This angle is variable dependent on the body structure of the individual. The angle can be adjusted into the variable pitch paddle 11 to suit the paddling style preferences of each individual. After this angle is set in the paddle 11 to allow the blade member 19 to enter the water in a straight cross plane to the canoe, a straight full stroke will turn the blade angle pitch toward the paddler during the stroke and the inside blade edge will automatically be upward at the end of a full stroke behind the paddler and canoe. This action creates a counter-turn pressure against the user's body mass and to the canoe correcting the ordinary turning force experienced in prior paddles. In summary, to set the variable pitch paddle 11 to any one of several discrete positions, the user simply pulls the grip member 13 straight up until it stops. Secondly, while the grip member 13 is in the up position, it is turned right or left to the desired position. Third, relaxing on the grip member 13 allows the compression spring means 37 to return the grip member 13 to its original position for further use.

Although the invention has been described and illustrated with respect to a preferred embodiment thereof, it is to be understood that it is not to be so limited since changes and modifications may be made therein which are within the full intended scope of the invention.

I claim:

1. A paddle for manually propelling waterborne craft, said paddle comprising a grip member establishing the upper end of said paddle and having major and minor axes thereto, a blade member establishing the lower end of said paddle, an elongated intermediate member having said grip member attached to the upper end thereof with said blade member being attached to the lower end thereof, pivot means coextending with the longitudinal axis of said paddle and being attached to said elongated intermediate member for providing pivotal movement of said grip member relative to said blade member whereby the major axis of said grip member may selectively be angularly aligned and disaligned with the plane of said blade member, and quick release locking means for selectively locking said grip member relative to said blade member in any one of several discrete predetermined positions while the craft is being propelled with said paddle.

2. The paddle of claim 1 in which said intermediate member includes a loom portion which is severed transversely thereof establishing distal and proximal loom elements with said pivot means pivotally connecting said distal and proximal loom elements one to the other, and said quick release locking means includes providing said distal loom element with a plurality of slots extending radially outwardly from said pivot means with said proximal loom element having tongue means projecting longitudinally towards said slots for selective thrusting reception therein to establish said several discrete predetermined positions of said quick release locking means.

3. The paddle of claim 2 in which said quick release locking means additionally includes compression spring means for yieldably urging said tongue means towards said slots, said tongue means being disengagable from said slots by compressing said spring means.

4. The paddle of claim 3 in which is included sleeve means for circumferentially engaging said distal and proximal loom elements, said proximal loom element being free to slide to and fro a predetermined distance along the longitudinal axis of said paddle and is free to rotate thereabout.

5. The paddle of claim 4 in which said proximal loom element is provided with a transverse groove disposed remotely from said tongue means thereof and a longitudinally extending aperture defined in part by an annular shoulder with said aperture leading outwardly into said transverse groove, said pivot means and said compression spring means being received in said aperture with one end of said compression spring means restingly engaging said annular shoulder, the lower portion of said grip member extending into said transverse groove obscuring said pivot means and said compression spring means, and said grip member being fixedly attached to said proximal loom element.

6. The paddle of claim 5 in which is included position alignment indicia means for facilitating the positioning of said grip member selectively to specific ones of said several discrete predetermined positions.

7. The paddle of claim 6 in which is included grapple means for seizing certain objects which may be situated in the vicinity of the waterborne craft.

8. A paddle for manually propelling waterborne craft, said paddle comprising a grip member having major and minor axes thereto, an elongated blade member having the longitudinal axis thereof disposed substantially perpendicular to said major and minor axes of said grip member, and intermediate member including a loom portion which is severed transversely thereof establishing distal and proximal loom elements, said distal loom element being fixedly attached to said blade member and said proximal loom element being fixedly attached to said grip member, pivot means coextending with the longitudinal axis of said paddle for pivotally connecting said distal and proximal elements one to the other whereby the major axis of said grip member may selectively be angularly aligned and disaligned with the plane of said blade member, said distal loom element being provided with a plurality of slots extending radially outwardly from said pivot means, said proximal loom element having tongue means projecting longitudinally towards said slots for selective thrusting reception and locking engagement therein whereby placing said tongue means in any one of said plurality of slots being effective to lock said distal and proximal loom elements one to the other, and compression spring means for yieldably urging said tongue means towards said slots with said tongue means being freely and quickly disengagable from said slots by compressing said spring means.

9. The paddle of claim 8 in which is included sleeve means for circumferentially engaging said distal and proximal loom elements, said proximal loom element being free to slide to and fro a predetermined distance along the longitudinal axis of said paddle and being free to rotate thereabout.

10. The paddle of claim 8 in which said pivot means includes a screw member having a head portion, said distal loom element being provided with a longitudinally extending concentric bore threadedly receiving the lower end of said screw member, said proximal loom element being provided with a longitudinally extending concentric aperture defined in part by an annular shoulder establishing small and large diameter portions for said aperture, said compression spring means being disposed in said large diameter portion of said aperture with the lower portion thereof restingly engaging said annular shoulder, said screw member extending through said aperture in said proximal loom element with said compression spring means being circumferentially disposed thereabout, and said head portion of said screw member capturing said compression spring means by engaging the upper end thereof.

11. A paddle for manually propelling waterborne craft, said paddle comprising a grip member establishing the upper end of said paddle and having major and minor axes thereto, a blade member establishing the lower end of said paddle, an elongated intermediate member having said grip member attached to the upper end thereof with said blade member being attached to the lower end thereof, said grip member being axially aligned with said elongated intermediate member, the major axis of said grip member being fixed in an angularly misaligned position relative to the plane of said blade member.

12. The paddle of claim 11 in which said grip member is angularly mislaigned with said plane of said blade member for right hand use.

13. The paddle of claim 11 in which said grip member is angularly misaligned with said plane of said blade member for left hand use.

14. An improved paddle for manually propelling a canoe or the like, the paddle being of the type having a blade member, a grip member and an elongated intermediate member rigidly constructed between the blade member and the grip member, the blade member having a relatively broad and flat free end to be dipped in and pulled through the water by the canoeist, the grip member having a generally flat body generally smaller than the blade member and having a free end normal to the axis of the elongated intermediate member, the elongated intermediate member having a smooth generally cylindrical body of a limited length and diameter such that the average canoeist can grip the same near its connection to the blade member with one hand while at the same time gripping the grip member with his other hand while in a sitting or kneeling position in the canoe, normal use of the paddle being to repeatedly dip the blade member into the water adjacent to one side of the canoe toward the front end thereof and ahead of the canoeist with the plane of the blade member at right angles to the desired line of canoe movement through the water in a J-stroke by first pulling the blade member backwardly through the water using the grip member as a moving fulcrum and then rotating the blade member outwardly to a position where the plane of the blade member is more nearly parallel to the desired line of travel, the normal use of the paddle being free of any connection to the canoe being propelled and the elongated intermediate member being free of any means for in anyway connecting the same to the canoe or the like, wherein the improvement comprises the grip member being formed so that the plane thereof is fixed in an angularly misaligned position relative to the plane of the blade member with said paddle resulting in an automatic change of blade pitch during the stroke equivalent to that of the J-stroke without requiring the canoeist to practice the J-stroke to maintain a straight course.

* * * * *